US006298615B1

(12) United States Patent
Richardson

(10) Patent No.: US 6,298,615 B1
(45) Date of Patent: Oct. 9, 2001

(54) FRAME FOR USE WITH REFRIGERATED ENCLOSURE AND METHOD OF MAKING THE SAME

(75) Inventor: Richard J. Richardson, Simi Valley, CA (US)

(73) Assignee: Anthony, Inc., San Fernando, CA (US)

( * ) Notice: Subject to any disclaimer, the term of this patent is extended or adjusted under 35 U.S.C. 154(b) by 0 days.

(21) Appl. No.: 09/165,585

(22) Filed: Oct. 2, 1998

Related U.S. Application Data

(63) Continuation-in-part of application No. 08/937,999, filed on Sep. 26, 1997, which is a continuation of application No. 08/543,043, filed on Oct. 13, 1995, now abandoned.

(51) Int. Cl.[7] ..... E04C 1/39

(52) U.S. Cl. ..... 52/204.5; 52/220.7; 52/220.5; 52/220.1; 49/504

(58) Field of Search ..... 52/204.5, 220.1, 52/220.5, 220.7; 49/DIG. 1, DIG. 2, 504

(56) References Cited

U.S. PATENT DOCUMENTS

| | | | | |
|---|---|---|---|---|
| 3,499,245 | * | 3/1970 | Winsler et al. | 49/504 X |
| 3,629,972 | * | 12/1971 | Rehberg et al. | 49/70 |
| 3,673,735 | * | 7/1972 | Winsler et al. | 49/70 |
| 4,004,370 | * | 1/1977 | Heaney | 49/504 X |
| 4,223,482 | * | 9/1980 | Barroero et al. | 49/504 X |
| 5,024,023 | * | 6/1991 | Kostos et al. | 49/504 X |
| 5,062,246 | * | 11/1991 | Sykes | 52/220.7 X |
| 5,111,618 | * | 5/1992 | Kaspar et al. | 49/501 |
| 5,214,890 | * | 6/1993 | Levitan et al. | 52/220.7 |
| 5,394,658 | * | 3/1995 | Schreiner et al. | 52/220.7 X |
| 5,645,330 | * | 7/1997 | Artwohl et al. | 49/504 X |
| 5,743,052 | * | 4/1998 | Mayhall et al. | 52/220.7 X |

* cited by examiner

*Primary Examiner*—Carl D. Friedman
*Assistant Examiner*—Phi Dieu Tran A
(74) *Attorney, Agent, or Firm*—Henricks, Slavin & Holmes

(57) ABSTRACT

A refrigerated enclosure frame including a frame member having a forward facing channel and at least one power transmission wire located within the forward facing channel.

3 Claims, 11 Drawing Sheets

FRAME FOR USE WITH REFRIGERATED ENCLOSURE AND METHOD OF MAKING THE SAME

CROSS-REFERENCE TO RELATED APPLICATIONS

This application is a continuation-in-part of co-pending U.S. application Ser. No. 08/937,999, filed Sep. 26, 1997, which is incorporated herein by reference, and which is a continuation of Ser. No. 08/543,043, filed Oct. 13, 1995, now abandoned.

BACKGROUND OF THE INVENTIONS

1. Field of Inventions

The present inventions relate generally to refrigerated enclosures such as refrigerated display cases and storage units.

2. Description of the Related Art

One type of refrigerated enclosure is a refrigerated display case, such as those commonly found in grocery stores, convenience stores and florist shops. The term "refrigerated" is used herein to refer both to refrigerators at temperatures above freezing and to freezers at temperatures below freezing. Refrigerated display cases are used to display products that must be stored at relatively low temperatures and often include shelves, glass doors and/or glass walls to permit viewing of the products supported by the shelves. Refrigerated storage units, another type of refrigerated enclosure, are commonly found in warehouses, restaurants and lounges. They may also include shelves and are used to store food, beverages and other items stored at relatively low temperatures. Refrigerated display cases and storage units may be free standing units or "built in" units that form an actual part of the building in which they are located.

Whether free standing or built in, the refrigerated enclosures typically include a frame that supports one or more doors. The frames, which essentially define the forward portion of the surrounding enclosure, include top, bottom and side members and, in those instances where the frame supports more than one door, one or more vertically extending mullions. The frames also include plastic insulation that covers the rearward facing portion of the frame (i.e. the portion of the frame which faces into the cold storage area of the enclosure) as well as the outwardly facing portions of the top, bottom and sides of the frame.

There are a number of electrical components associated with the frame. For example, resistive wire heating elements are located in the enclosure perimeter frame members, the mullion and often the doors in order to prevent the condensation of moisture on the frame and doors. Typically, there is one heating element for the perimeter frame members and one for each mullion. Lighting fixtures, which typically include electric lamps, lenses and reflectors, are commonly secured to the rearward facing portion of the frame, which defines the forward portion of the enclosure. Light from the fixtures is directed rearwardly to illuminate the products within the enclosure.

In conventional frames, power transmission (or "power supply") wiring for the various electrical components is located within a raceway that extends along the rearward facing portion of the frame. Some conventional rearward facing raceways consist of U-shaped channels which are fastened to the rearward side of the enclosure frame over the plastic insulation. Such a raceway is disclosed in U.S. Pat. No. 3,499,245. In another conventional rearward facing raceway, a portion of the raceway is integral with the plastic insulation on the rearward facing portion of the frame. A separate cover is used to complete this variety of raceway.

The power transmission wiring is connected to the electrical components by extending lead wires from each electrical component through holes in the frame that lead into the raceway. Once a wire (or plurality of wires) is fed through the hole, the space between the lead wire and the perimeter of the hole must be filled with a plug, grommet or small amount of putty to prevent icing (which can occur when the cold air from within the cold storage area meets warm, moist air from outside the enclosure) and/or wire damage. With respect to the heating elements, the use of lead wires in this manner requires two connectors to be crimped onto each lead wire, one to connect the heating element to the lead wire, and one to connect the lead wire to the power transmission wire.

Moreover, two lead wires are required for each heating element, one for the "hot" connection and one for the "neutral" connection.

The inventor herein has determined that the process of connecting the power transmission wiring located within the rearward raceway to the electrical components is unnecessarily time consuming, labor intensive and expensive.

For example, installation of the electrical components in a conventional frame requires the entire frame to be flipped over four times, which is quite difficult because the frame is heavy and awkward. In a two-door (i.e. single mullion) arrangement for example, once the top, bottom and side frame members are welded together, the mullion (with lighting ballasts secured to the forward facing side thereof) is riveted or otherwise secured to the top and bottom frame members and the plastic insulation and integral raceway are secured to the rearward facing portion of the frame members. The frame is then flipped over a first time such that the raceway is facing down. The heating elements are then secured within channels in the frame. The lead wires from the heating elements are fed through holes in the frame into the raceway. This process involves crimping a connector onto the heating element, crimping one end of a lead wire to the connector and passing the lead wire through a small hole in the frame. The power input wires for the hinge pin sockets are also fed through holes in the frame into the rearward facing raceway. Grommets are then inserted into the holes. Next, the frame is flipped over a second time such that the raceway is facing up. The heating element circuits are then completed, as are the hinge pin socket power input wires. To complete the circuits, connectors are crimped onto the ends of each of the heating element lead wires and hinge pin socket power input wires in the rearward facing raceway. Many power transmission wires are then placed into the raceway. One "hot" and one "neutral" power transmission wire are used for the heating elements, while one "hot," one "neutral" and one "ground" power transmission wire are used for the hinge pin sockets. Connectors are used to connect the lead wires to power transmission wires. The time consuming conventional process of crimping the connectors onto the power transmission wires is discussed in detail below. The power transmission wires for the lighting circuit are placed into the raceway and then fed into the mullion, where the ballasts are located, through either the open end of the mullion or through a suitably placed punched hole in the mullion. The frame is then flipped over a third time such that the raceway is facing down and the forward facing side of the mullion is visible with the ballast exposed The power transmission wires are connected to the input side of the ballast. Additional power transmission wires are connected to the output side of the ballasts. Some of the power transmission wires from the output side of the ballast are connected to the lamp sockets on the rearward facing side of the mullion. This can be accomplished because in some conventional frames, the mullion includes holes that are aligned with the portions of the lamp sockets into which the power transmission wires are inserted. The other power transmission wires from the output side of the ballast, i.e. those which are associated with lamps on the rearward facing portion of the side frame members, are then threaded into the raceway through a grommeted hole. Next, contact plates are placed over the mullion and perimeter of the frame. The contact plates are secured in place with a zipper strip. The frame is then flipped over a fourth time such that the raceway is facing up. The wires from the output side of the ballasts are then run through the raceway to the sockets associated with the lamps on the side frame members. The sockets are secured to respective vertically extending plastic lamp support assemblies that are used to cover the rearward facing raceways on the vertically extending side frame members. Finally, once the lamp support assemblies are in place, covers are secured over the horizontal rearward facing raceways on the top and bottom frame members.

As alluded to above, other disadvantages associated with conventional rearward facing raceway frames are related to the multitude of crimped-on connectors that are used to connect the electrical components to the power transmission wires. For example, the above-described conventional two-door frame requires two heating elements and three hinge pin connectors (two singles and a double). Connection of the heating elements to the power transmission wires requires the use of eight crimp-on connectors, two to connect each heating element to the "hot" power transmission wire and two to connect each heating element to the "neutral" power transmission wire. The single hinge pin connectors require three crimp-on connectors each for the "hot," "neutral" and "ground" power transmission wires, while the double connector requires six. The crimping process time consuming and expensive.

Is also difficult to service refrigerated enclosures having conventional rearward facing raceway frames. For example, the large number of wires and phalanx of connectors makes it very difficult to traces wires to and from the electrical component to which they are connected. In addition, much of the power transmission wiring is separated from the associated electrical components by a frame member, which also makes it difficult to trace wires to a particular component.

The use of conventional rearward facing raceways also increases the thickness of the frame which, in many instances, is undesirable because of space constraints.

SUMMARY OF THE INVENTIONS

Accordingly, the present inventions provide a refrigerated display case frame, and a method of making a display case frame which avoid, for practical purposes, one or more of the aforementioned problems.

In accordance with one aspect of the present inventions, a frame in one preferred embodiment includes a frame member having a forward facing channel and at least one power transmission wire located within the forward facing channel.

The present invention provides a number of advantages over conventional designs. For example, frames manufactured in accordance with the present invention do not have to be flipped during assembly as many times as in conventional processes. Preferably, the frame is flipped no more than twice.

In an exemplary manufacturing process involving a two-door embodiment of the present frame, the top, bottom and side frame members are welded together, the mullion is attached to the top and bottom frame members and the plastic insulation is secured to the rearward facing side of the frame. The frame is then flipped over a first time such that the uncovered forward facing raceway and uncovered mullion channel are both facing upwardly. The mullion and forward facing raceway together define a continuous forward facing channel which extends around the periphery of the frame and from the top frame member to the bottom frame member (by way of the mullion channel). This channel allows essentially all of the wiring for the electrical components to be installed without flipping the frame.

For example, the heating elements may be secured to the walls of the forward facing raceway and mullion channel and the power transmission wires for the heating elements may be directly connected to the heating elements, as may the power transmission wires for the hinge pin sockets after they are installed. The conventional manufacturing steps of crimping a lead wire onto the heating elements and running the lead wires and the hinge pin power input wires through holes in the frame into a rearwardly facing raceway, and sealing the holes with grommets are eliminated.

The next exemplary manufacturing step is to connect power transmission wires to the input sides of the ballasts and then to run additional power transmission wires from the output sides of the ballasts to the appropriate portions of the frame, i.e. the top and bottom areas of the mullion and side frame members. The ends of the power transmission wires (one pair per lamp end), which each have a small pin-type connector thereon, are passed through holes in the frame adjacent to the lamp sockets. Contact plates are then placed over the mullion and forward facing raceway. The frame is then flipped over a second and final time. Next, each pair of small pin-type connectors are inserted into one larger connector which is, in turn, secured to a corresponding connector on the lamp socket, thereby completing the installation of the electrical components.

In addition to reducing the number of times that the frame must be flipped over during the assembly process, the present invention also results in a reduction in the number of times a connector must be crimped onto a wire, thereby reducing labor and material costs. This is because lead wires do not have to be crimped onto the heating element and fed through an opening in a frame member to a rearward facing raceway. The present invention also results in a reduction in the number of holes that must be punched into the frame and the number of grommets that must be installed, which results in further reductions in labor and material costs. Fewer holes also lead to a more thermally efficient assembly.

Another advantage associated with the present frame is that it is easier to service than conventional frames that have some of the wiring on the forward facing side of the frame (within the mullion), other wiring within the rearward facing raceway (and, thus, not visible from the forward side) and a phalanx of connectors. For example, it is much easier to determine which of the power transmission wires is associated with the heating elements because both are located within a forward facing raceway.

Absent the rearward facing raceway, the present frame is also smaller than conventional frames while having the same raceway area, and does not protrude into the refrigerated case as far as a conventional frame.

In order to accomplish some of the aforementioned and other objectives, a refrigerated enclosure frame in accordance with a preferred embodiment of a present invention includes a frame member having a wiring channel, a first power transmission wire located within the wiring channel, a connector including a single input and a plurality of outputs, the first power transmission wire being connected to the connector input, and at least second and third power transmission wires connected to the connector output. Such an arrangement eliminates the use of many of the crimp-on connectors required by conventional wiring methods. As a result, refrigerated enclosure frames in accordance with the present inventions may be manufactured faster than conventional frames and at a lower cost. The manufacture of refrigerated enclosure frames in accordance with the present inventions is also likely to be more efficient. The present method of connecting the wires also results in an overall wiring scheme which is much easier to service because the number of wires and connectors is greatly reduced, thereby making it easier to trace wires to and from particular electrical components.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known modes of carrying out the inventions. This description is not to be taken in a limiting sense, but is made merely for the purpose of illustrating the general principles of the invention.

Figure 1:
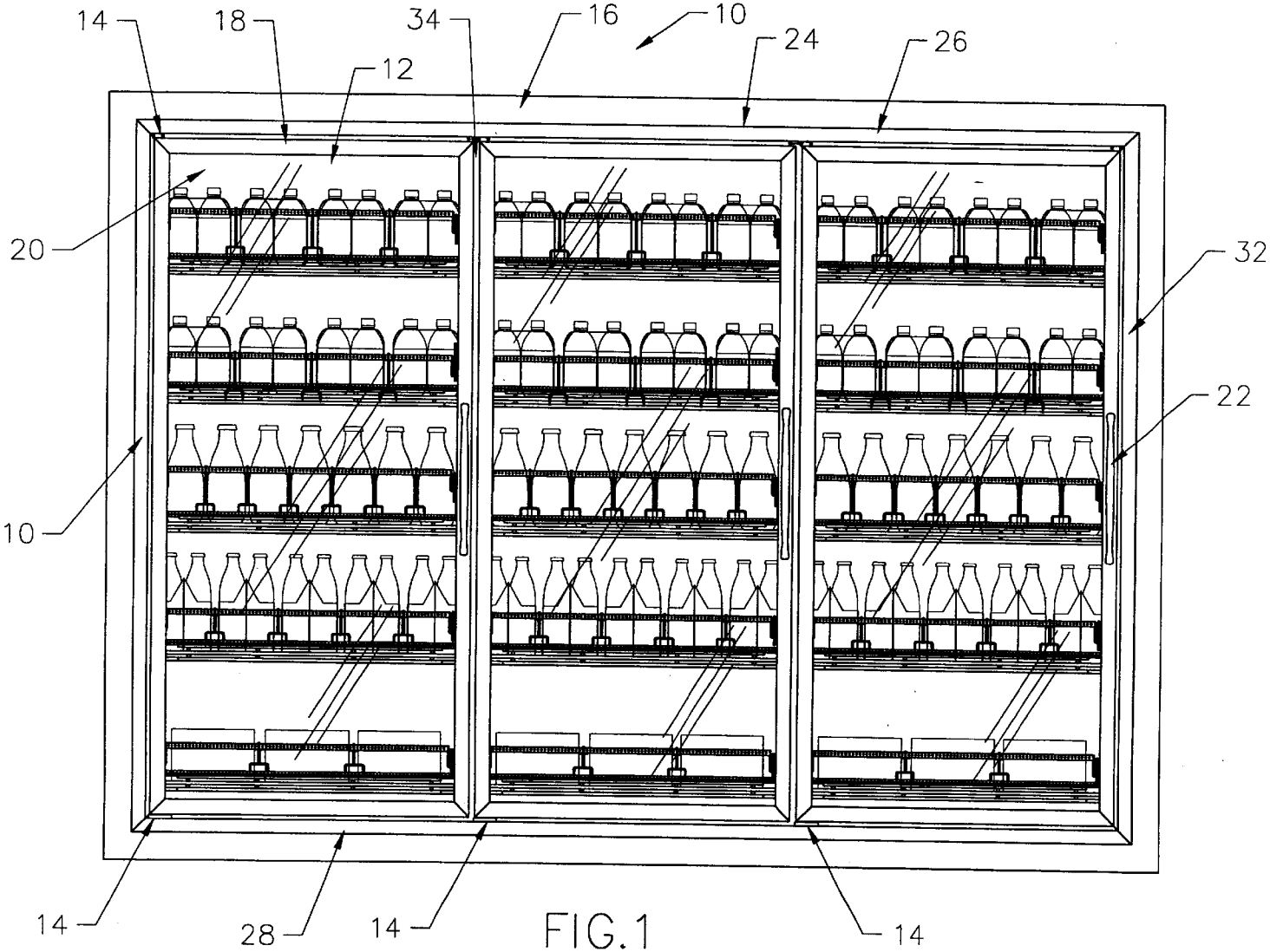
FIG. 1 is a front elevation view of an exemplary refrigerated enclosure having a plurality of doors.
Figure 2:
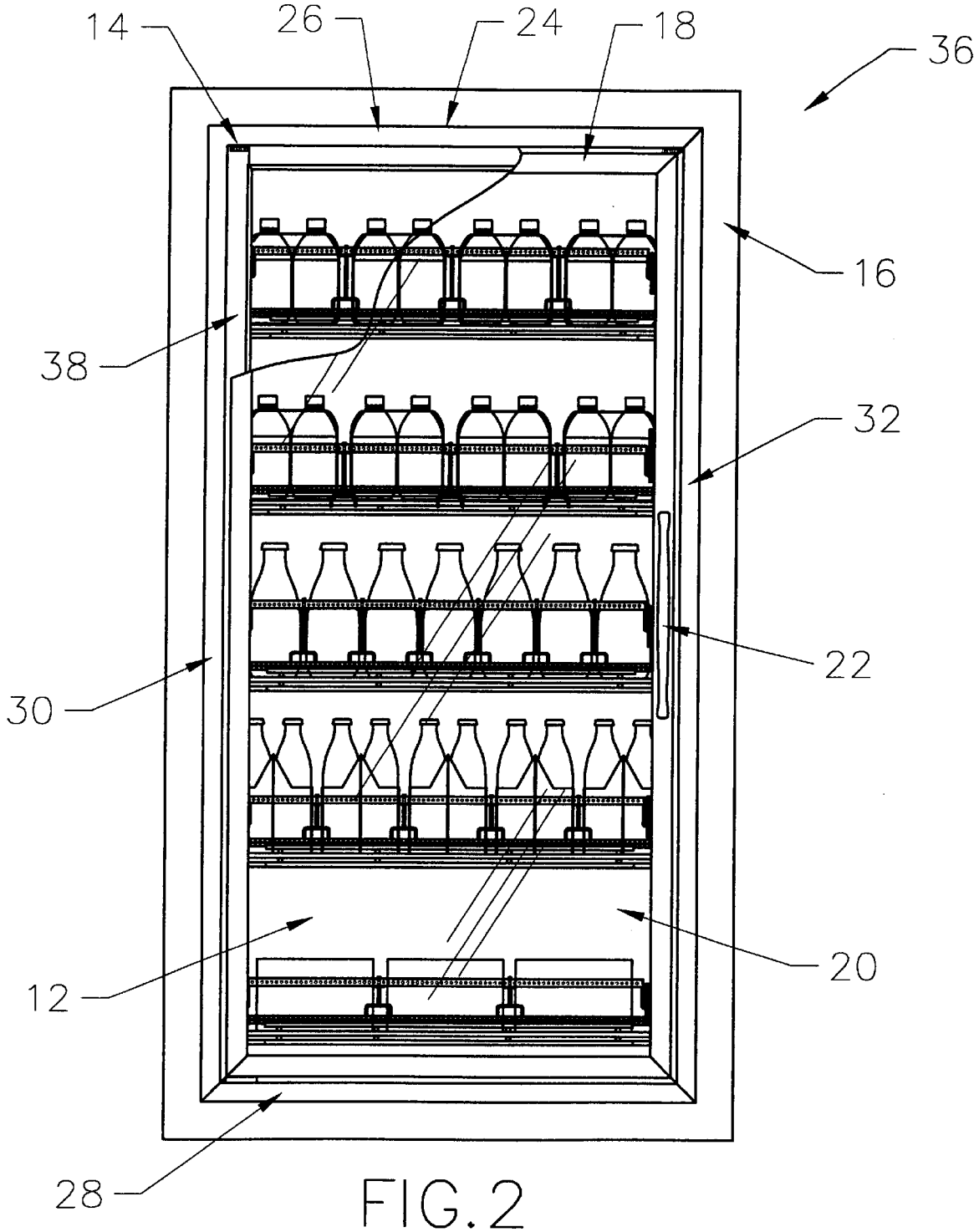
FIG. 2 is a partial cutaway front elevation view of an exemplary refrigerated enclosure having a single door.

An exemplary refrigerated enclosure frame and door assembly 10 is illustrated in FIG. 1. The frame and door assembly 10, which may be incorporated into both free standing and built-in enclosures, includes a plurality of doors 12 that are pivotally mounted on the frame by hinges 14. The front portion of the enclosure is identified by reference numeral 16. The doors 12 include a door frame 18, a glass panel assembly 20 and handles 22. The enclosure frame, which is identified by reference numeral 24, includes top and bottom frame members 26 and 28 and side frame members 30 and 32. A pair of mullions 34 are also included in the illustrated three-door assembly in order to provide contact surfaces for the three doors. Turning to FIG. 2, a single door frame and door assembly 36 includes many of the same elements as the multi-door assembly 10. The single door assembly 36 does not, however, include mullions.

As best seen in FIG. 2, the exemplary frame and door assemblies also include a series of contact plates 38 located behind the top, bottom and sides of the door frame 18. Thus, the contact plates are associated with the top, bottom and side enclosure frame members 26, 28, 30 and 32, as well as the mullions 34 in a multi-door assembly. The contact plates 38 combine with a gasket (not shown) to provide a seal between the doors 12 and the enclosure frame 24. The gasket preferably is of the conventional type that employs a flexible bellows and magnet arrangement.

Figure 3:
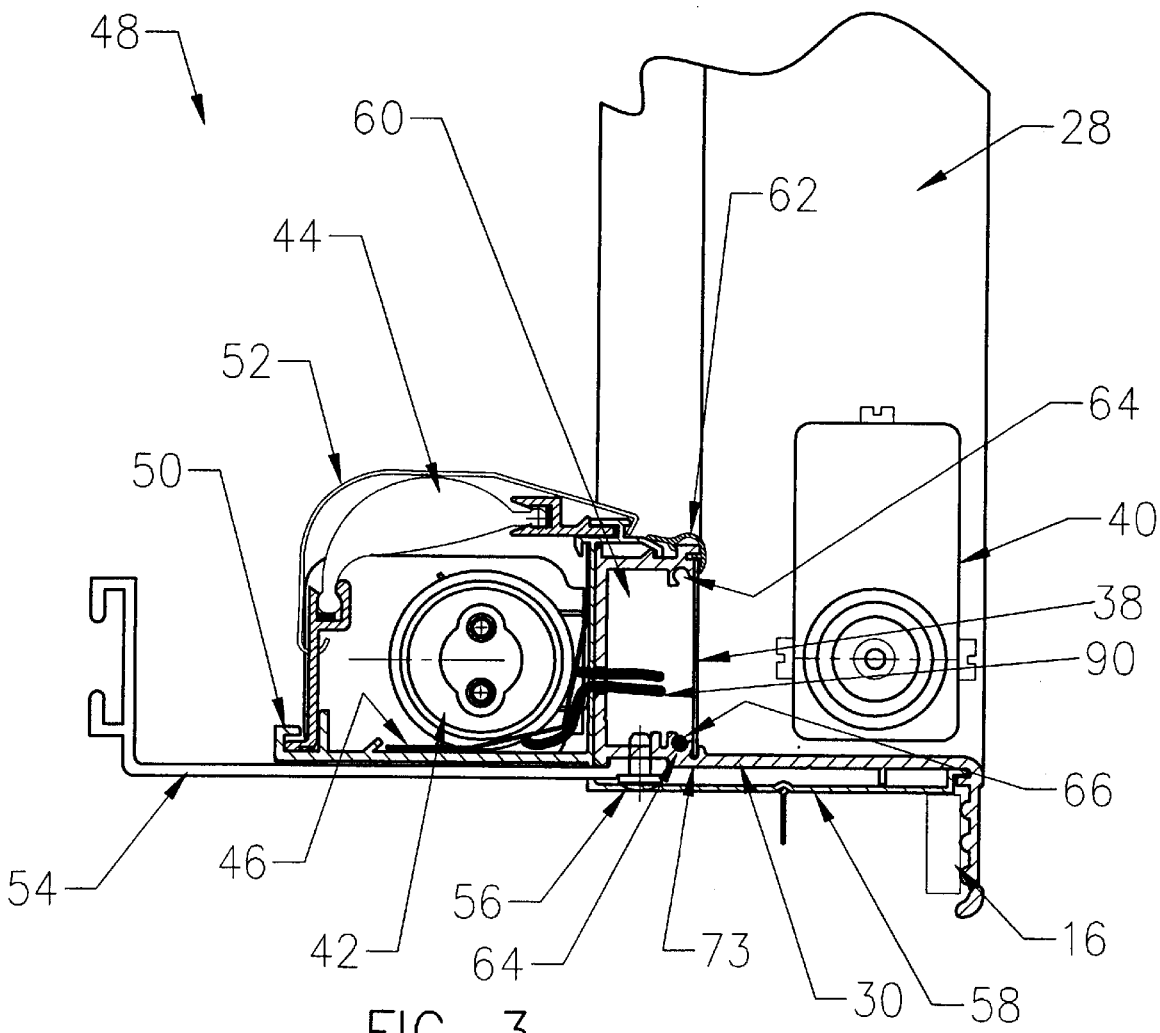
FIG. 3 is a partial top section view of a portion of a refrigerated enclosure frame and lamp assembly in accordance with a preferred embodiment of a present invention.

As shown by way of example in FIG. 3, the doors are preferably mounted on an adjustable gib 40 such as that shown in U.S. Pat. No. 4,696,078. With respect to lighting, the side frame members (side frame member 30 is shown) in the exemplary frame and door assemblies are provided with an electric lamp 42, lens 44 and reflector 46. The lamp, lens and reflector define a lighting assembly that helps to illuminate the cold storage area 48, which is rearward of the frame and door assembly. The lighting assembly is supported in part by a mounting bracket 50. A bracket 52 helps to hold the lens 44 in place. A shelf bracket 54, which is used to assist in the stabilization of shelf assemblies located within the cold storage area, may be secured to the side frame member 30 by a bolt 56 or other suitable fastening device. Insulating plastic members 58 are positioned around the perimeter of the enclosure frame in order to prevent unwanted heat transfer.

As illustrated for example in FIG. 3, the side frame members (such as side frame member 30) are provided with a forward facing raceway 60. The descriptive term "forward facing" is used herein to describe a raceway which faces other than directly rearwardly. In the illustrated embodiments, the raceways faces exactly forwardly, i.e. straight out of the cold storage compartment through the doors. The forward facing raceway 60 is covered by one of the contact plates 38 and the contact plate is held in place by a zipper-strip 62 or other suitable fastening device. The forward facing raceway 60 includes a pair of grooves 64 that secure one or more longitudinally extending heating elements 66 within the raceway. Only one of the grooves 64 in each frame member is used in the illustrated embodiment. The heating elements are preferably resistive heating type heating elements.

In accordance with one aspect of a present invention, and as shown by way of example in FIG. 3, at least one power transmission wire (i.e. a wire that provides power to an electrical component such as a lamp) is located within the forward facing raceway 60. In FIG. 3, power transmission wire pair 90, which is discussed below, is shown. The forward facing raceway in the exemplary embodiment illustrated in FIG. 3 is located within the side frame member 30. As such, the power transmission wires include power transmission wires for the electric lamp socket 42 and may include power transmission wires for the heating elements which occupy grooves 64 if desired. Power transmission wires for the heating elements located in the door frame and/or a conductive coating on the door glass are preferably located in the forward facing raceway of the top frame member 26. Power is transmitted to the door by way of a hinge pin socket associated with the gib 40. An exemplary hinge pin socket is shown in U.S. Pat. No. 4,671,582. In the preferred embodiment, all of the power transmission wires for the frame and door assembly are provided in the forward facing raceway of the frame assembly.

Figure 4:
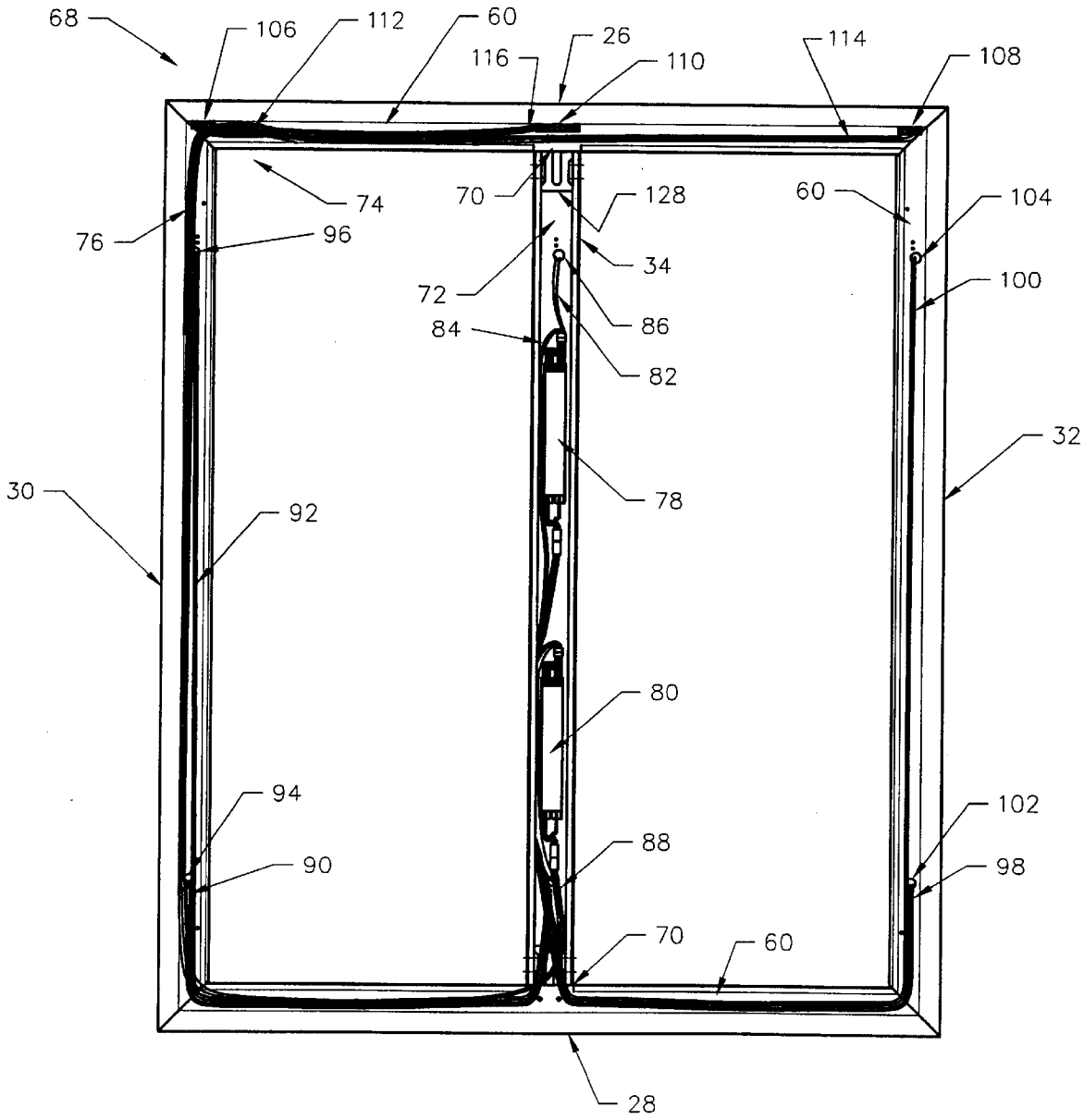
FIG. 4 is a front elevation view of a refrigerated enclosure frame in accordance with a preferred embodiment of a present invention.
Figure 8:
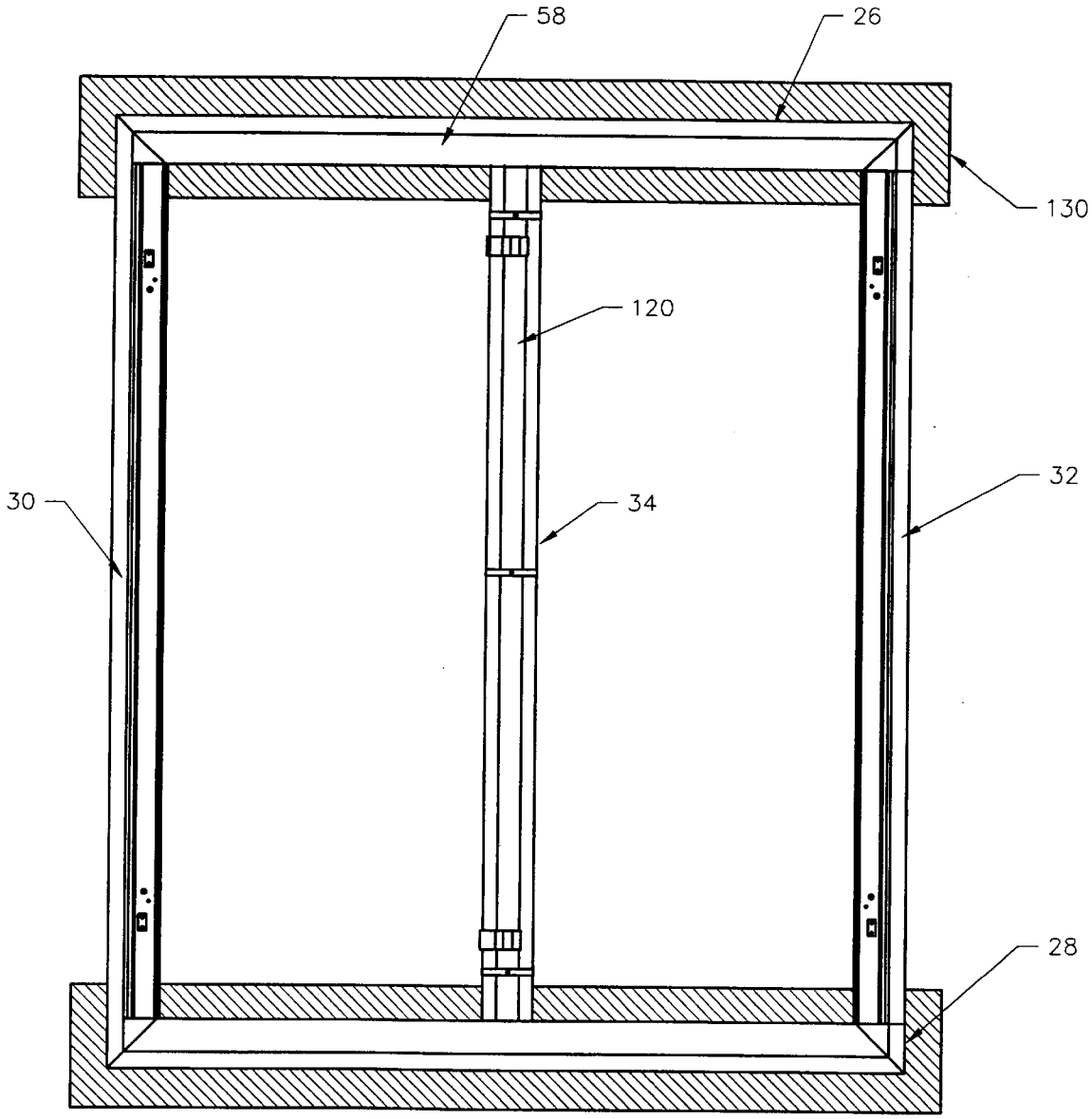

An exemplary two-door frame 68 in accordance with a preferred embodiment of the present invention is illustrated in FIG. 4, with the forward facing raceway uncovered. Frame 68 includes top, bottom and side frame members 26, 28, 30 and 32, each having a forward facing raceway 60, and a mullion 34. The top and bottom frame members 26 and 28 have cut-out portions 70 that are aligned with a channel 72 in the mullion 34. As such, the forward facing raceways 60 combine with the mullion channel 72 to form a continuous substantially "figure-8" shaped wiring channel. This continuous channel allows manufacturers to rapidly install the various power transmission wires in an organized manner, and it allows maintenance personnel to easily access, locate and repair or replace electrical components. It also allows further secondary benefits not easily achieved in conventional assemblies, such as pre-connected and assembled wiring bundles, and color-coding of wiring and harnesses.

In a preferred embodiment, the forward facing raceways 60 have forward surfaces 73 (FIGS. 3 and 6) defined by the grooves or ridges against which the contact plates 38 rest. The forward surfaces preferably extend completely around the frame at the same relative position in the frame so that the forward-most point of the forward facing raceway is uniform for the entire frame. The depth of the forward facing raceway 60 is preferably sufficient to accommodate the wires and couplings that will be used in the frame, and is preferably approximately the same depth and width as conventional raceways, such as those used by Anthony's Manufacturing Company, Inc. Moreover, the transitions between vertical and horizontal raceway portions, and between horizontal raceway portions and the vertical mullion channels is preferably unobstructed so that assembly of the frame and wires, and maintenance and repair of the wiring and components is as easy as possible. Keeping the wiring in the same vertical plane as they run along the raceway portions of the frame reduces the possibility wire being cut or crimped at a comer or rough edge, and makes the frame and wiring easier to use.

The depth of the mullion channel 72 is preferably the same as or a greater depth than the raceway depth, for example to accept the lamp ballasts and any other hardware that might be placed in the mullion. As such, the wireway made up of the forward facing raceway and the mullion channel is continuous throughout the frame and the mullion channel, is preferably entirely forward facing and accessible by merely removing one or more contact plates. Such a configuration allows all of the supply wires from an external supply for the frame and door assembly to come into the raceway through the frame and be connected to appropriate power transmission wires as desired.

For example, in the exemplary embodiment illustrated in FIG. 4, a plurality of power transmission wires from a junction box or other power supply apparatus enter the frame in area 74. Power transmission wires 76 are run along the forward facing raceways in the side frame member 30 and bottom frame member 28 to the mullion channel 72 where they are connected to the input sides of ballasts 78 and 80. Ballast 78 is a single lamp ballast and two power transmission wire pairs 82 and 84 are run from the output side of the ballast through respective mullion holes 86 and 88, which are aligned with or positioned close to the socket connectors for an electric lamp in a lighting assembly on the rearward facing side of the mullion. This aspect of the preferred embodiment is described below with reference to FIG. 5. Power transmission wires from the output side of ballast 80, a two lamp ballast, are run through holes in the side frame members 30 and 32 that are also aligned with or positioned close to electric lamp socket connectors. Specifically, two power transmission wire pairs 90 and 92 are run from the output side of the ballast through holes 94 and 96 in side frame member 30, and two power transmission wire pairs 98 and 100 are run from the output side of the ballast 80 through holes 102 and 104 in side frame member 32. This aspect of the preferred embodiment is described below with reference to FIG. 6.

Turning to the gibs, the exemplary embodiment illustrated in FIG. 4 includes three gibs, two single gibs 106 and 108 and a double gib 110. This arrangement allows the doors to be reversed, if necessary. Single sets of three power transmission wires 112 and 114 are connected to the sockets in the backs of the gibs 106 and 108 and a double set of three power transmission wires 116 is connected to the sockets in the back of the double gib 110, a hot, neutral and ground to each hinge pin socket in the double gib 110.

Finally, although not shown in FIG. 4 for the sake of clarity, the exemplary two-door frame 68 includes heating elements and power transmission wires for the heating elements within the forward facing raceways 60 and the mullion channel 72.

Locating the power transmission wire(s) within the forward facing raceway greatly reduces the amount of time and effort required to install the wiring for the electrical components associate with the frame. For example, the present frame need only be flipped over twice during the assembly process, which is about half as many times as some assembly procedures used in some conventional frames. The present assembly process is discussed below with reference to FIGS. 7–10. The number of connectors that must be used, as well as the number of holes that must be formed in the frame, are also reduced because there is no need to run wires from the forward side of the frame into a rearward facing raceway. The thickness of the frame from front to back is also reduced, as compared to conventional frames that include the rearward facing raceway.

Figure 5:
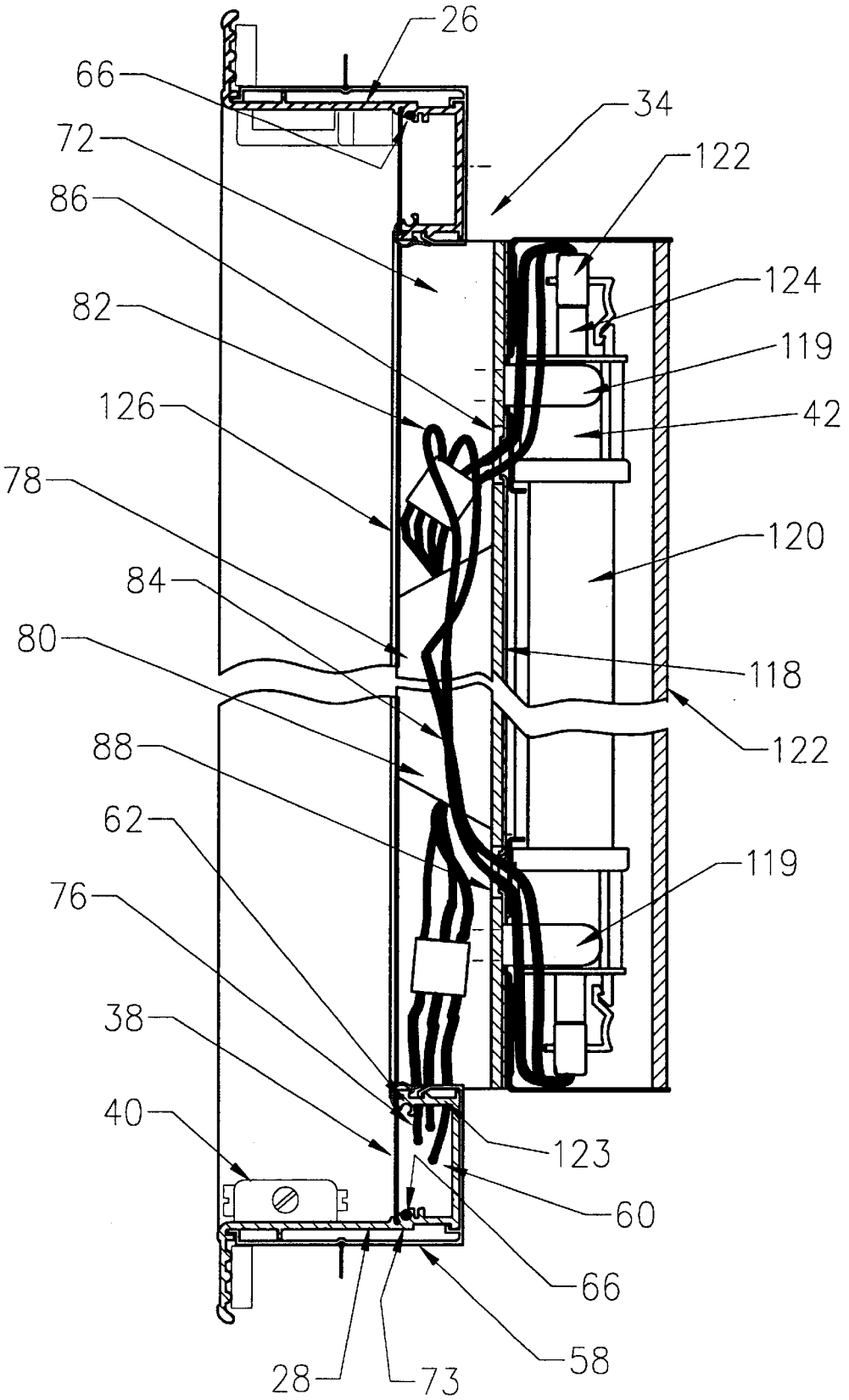
FIG. 5 is a partial section view showing a mullion and top and bottom frame members in accordance with a preferred embodiment of a present invention.

An exemplary arrangement for connecting the power transmission wires to the electric lamp on the rearward facing side of the mullion 34 is illustrated in FIG. 5. A plastic mounting bracket 118 supports, through one or more clips 119, a pair of lamp sockets 42, between which a lamp 120 is mounted, and also supports a lens assembly 122. As noted above, power is supplied to the ballast 80 (shown as the lower ballast in FIG. 5) by way of transmission wires 76 which pass along the forward facing raceway 60 and through one of the openings 70 (not shown in FIG. 5) formed or cut in the inner-most wall 123, and into the mullion channel 72. The incoming power transmission wires for each of the ballasts (three wires each, typically) pass up the mullion channel to the ballasts. However, only three are shown in FIG. 5 for simplicity, while it should be understood that six wires would pass up the mullion channel for two ballasts. Output power transmission wire pairs 82 and 84 pass through openings 86 and 88 in the back side of the mullion and are inserted into connectors 122 which mate with connectors 124 on the sockets 42. Grommets, plugs or putty may then be used to close the openings 86 and 88 in the conventional way. A contact plate 126 covers the mullion channel 72 in a manner similar to the contact plates 38, which cover the forward facing raceways 60.

Figure 6:
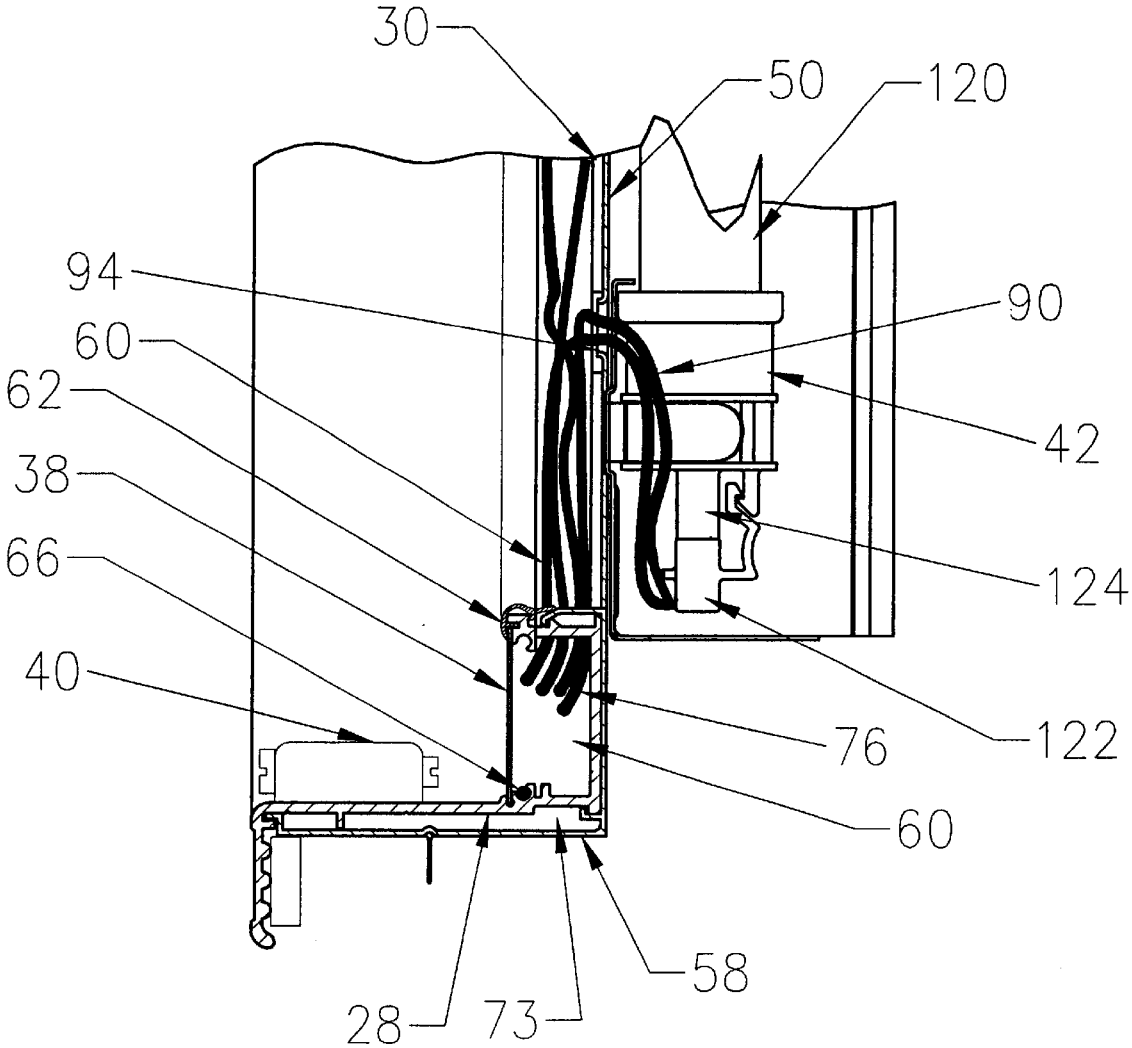
FIG. 6 is a partial side section view of a portion of a refrigerated enclosure frame and lamp assembly in accordance with a preferred embodiment of a present invention.

An exemplary arrangement for connecting the power transmission wires to the electric lamps on rearward facing sides of the side frame members is illustrated in FIG. 6. As discussed above with reference to FIG. 3, a plastic mounting bracket 50, through clips 127, supports a pair of sockets 42 between which a lamp 120 is mounted. Power transmission wires 90 from the output side of ballast 80 in the mullion are run along the bottom raceway, through the opening 70 (not shown in FIG. 6) and up the side raceway. Power transmission wires 90 then pass through opening 94 and are inserted into a connector 122 which mates with a connector 124 on the socket 42.

Figure 7:
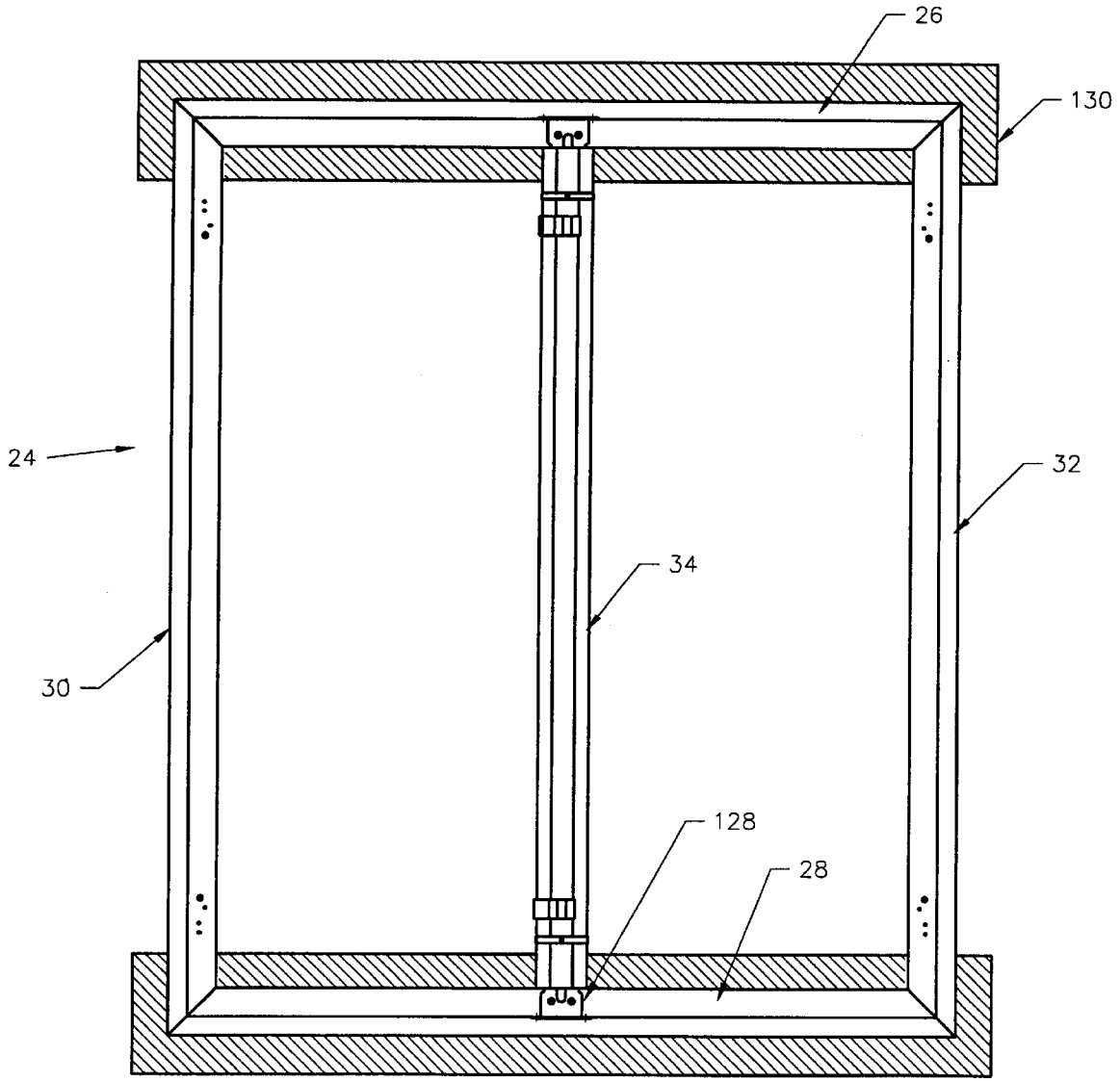
FIGS. 7–10 are plan views showing a refrigerated enclosure frame during various stages of the assembly process in accordance with a preferred embodiment of a present invention.

One exemplary method of assembling a two-door enclosure frame in accordance with a present invention will now be described with reference to FIGS. 7–10. Referring first to FIG. 7, the initial assembly steps include welding the top, bottom and side frame members 26, 28, 30 and 32 to one another and securing the mullion 34 to the top and bottom frame members with brackets 128. The mullion 34 already includes the various lighting components at this point. The lighting assemblies for the end frame members are also installed on their respective frame elements, including the related plastic insulation. The frame 24, which is oriented such that the forward facing raceway is facing downwardly, is preferably supported by a pair of support tables 130. The insulating plastic members 58 are also installed (see FIG. 8) on the top and bottom frame members 26 and 28 while the enclosure frame is oriented in this manner. Insulating plastic members cover the top and rear sides of the top frame member 26 and the bottom and rear sides of the bottom frame member 28.

Figure 9:
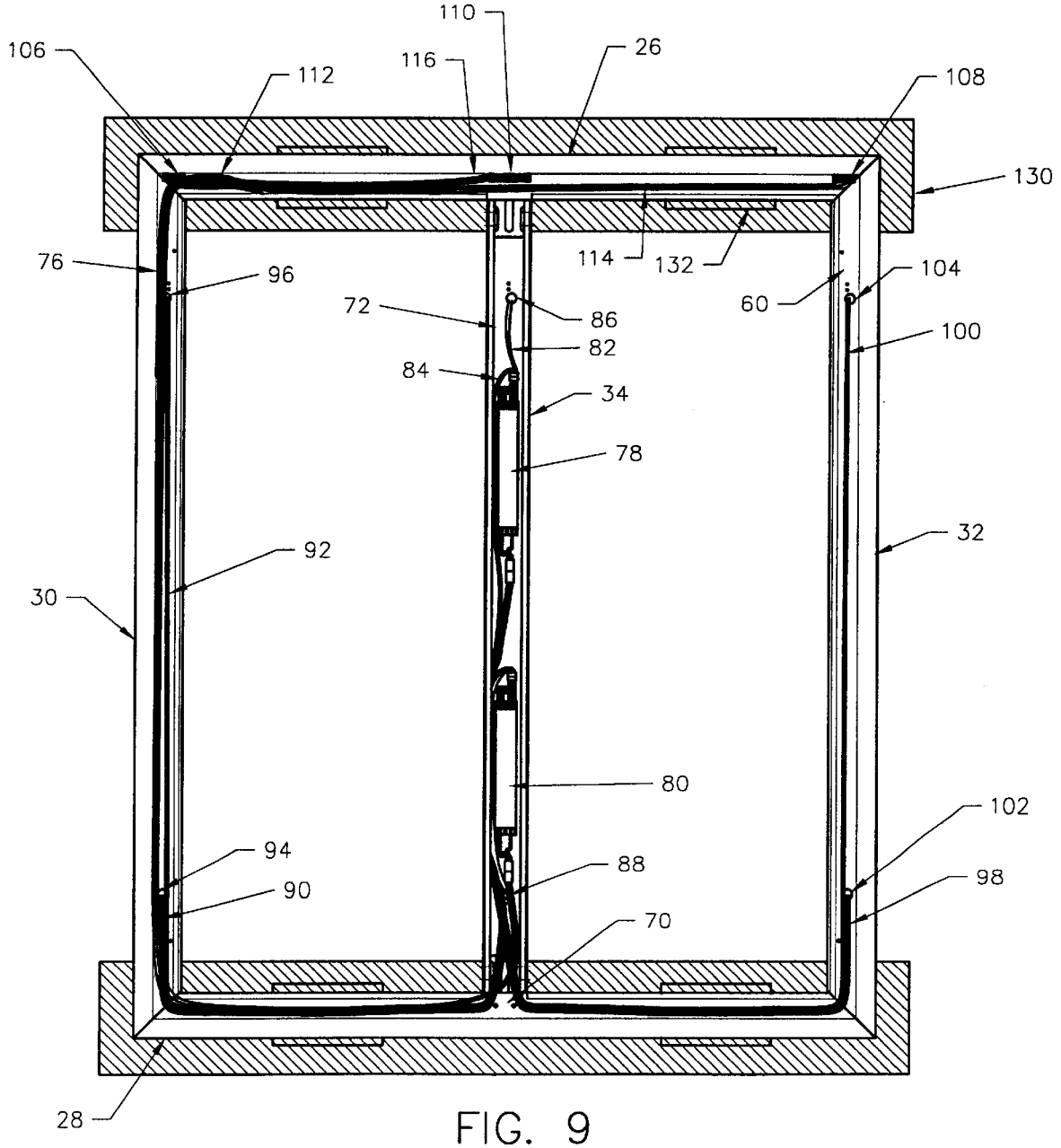

As shown by way of example in FIG. 9, after the insulating plastic members 58 are to secured to the frame, the frame is flipped over so that the forward facing raceways 60 and mullion channel 72 are facing upwardly. Additional supports 132 may be used to provide clearance for the lighting fixtures on the rearward side of the mullion 34 and, when used, shelving brackets on the rearward side of the mullion and side frame members 30 and 32. The heating elements 66, power transmission wires 76, 82, 84, 90, 92, 98 and 100 (associated with the electric lamps and ballasts), and power transmission wires 112, 114 and 116 (associated with the hinge pin sockets) may then be installed, as discussed in greater detail above with reference to FIG. 4.

Figure 10:
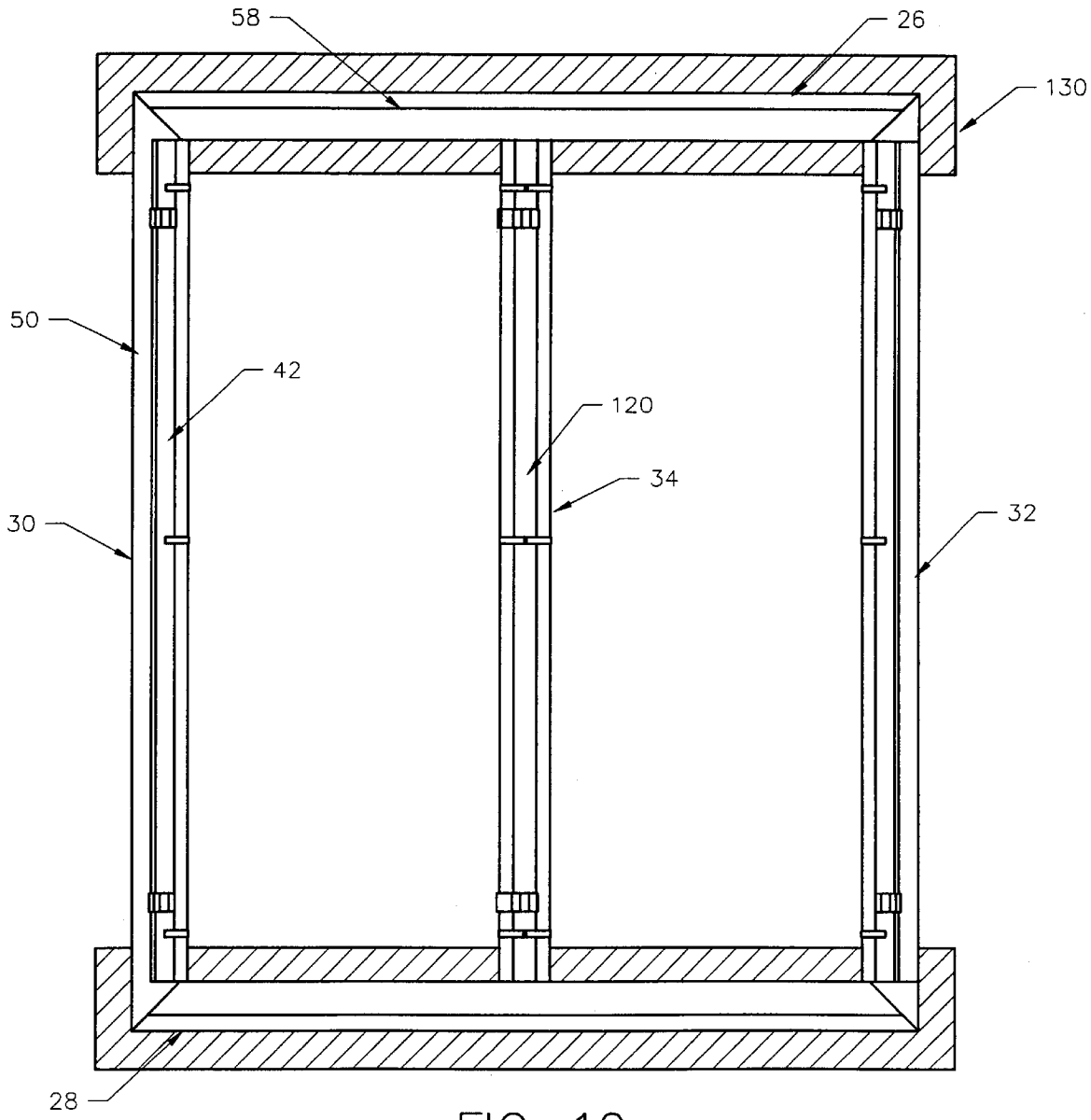

The frame is then flipped over a second and final time so that the rearward facing portions of the top, bottom and side frame members and the mullion are facing upwardly. As illustrated in FIG. 10, the plastic mounting brackets 50 and integral insulating plastic are then secured to the side frame members 30 and 32. The power transmission wires associated therewith (i.e. power transmission wire pairs 90, 92, 98 and 100) are then connected to the sockets to complete the assembly process.

Turning to the wire couplings, and in accordance with another invention herein, a plurality of one wire in/many wire out couplings or expansion couplings may be used to connect wires within the raceway of a refrigerated enclosure frame. As illustrated for example in FIG. 11, such couplings are preferably used in combination with a frame including forward facing raceways 60 because the forward facing raceways lend themselves to use of such couplings and pre-assembled couplings and wiring harnesses.

Figure 11:
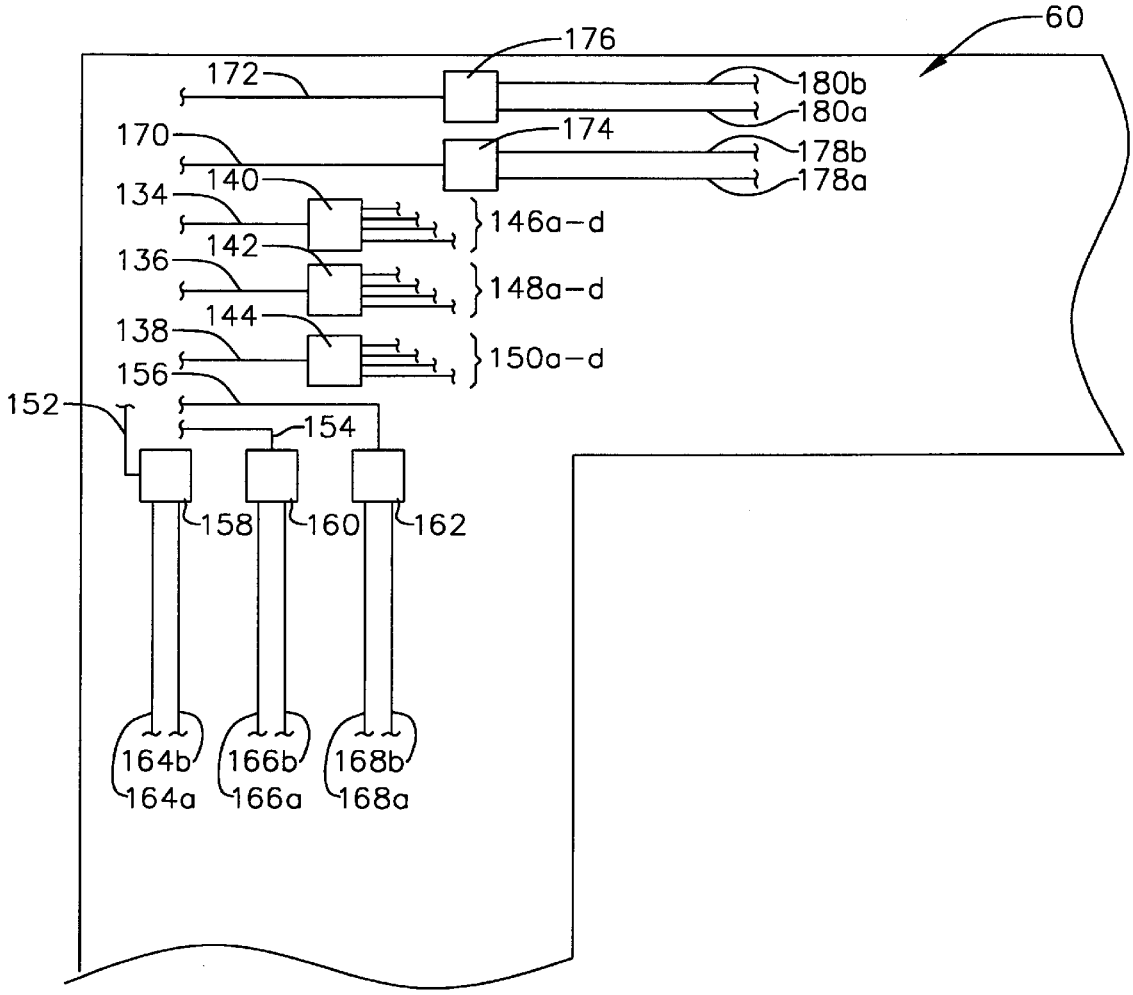
FIG. 11 is a schematic diagram of a refrigerated enclosure frame wiring arrangement in accordance with a preferred embodiment of a present invention.

The exemplary wiring configuration illustrated in FIG. 11 is one which may be used in combination with a two-door frame having reversible doors. Thus, with respect to the hinge pin connectors, there are two single hinge pin connectors and one double hinge pin connector. Three power transmission wires ("hot," "neutral" and "ground") are connected to each single hinge pin connector and six power transmission wires (two "hot," two "neutral" and two "ground") are connected to the double. In the illustrated embodiment, this is accomplished in part by bringing "hot," "neutral" and "ground" door power transmission wires 134, 136 and 138 into the frame and connecting them to one wire in/many wire out couplings 140, 142 and 144. It should be understood that the power transmission wires from the case or other external source can come in at any number of locations around the frame. Therefore, bringing the power in at one comer or part of the frame or another is a matter of design choice. Preferred one wire in/many wire out couplings include the connectors manufactured by Wago Kontakttechnik GmbH., such as their push wire connectors. However, the expansion connectors shown in FIG. 11 are shown as generic connectors having a supply wire coming in one side and output wires exiting the opposite side. Hot power transmission wires 146*a–d* from the hinge pin connectors (one wire from each single and two wires from the double) are then connected to the one wire in/many wire out couplings 140. Similarly, neutral and ground power transmission wires 148*a–d* and 150*a–d* are connected to neutral and ground couplings 142 and 144, respectively.

These expansion connectors can be used in any number of combinations, while still achieving a reduction in the number of connectors used in the frame assembly. Because many frames are built to custom specifications or dimensions, the wiring and connection combinations sometimes are unique to the configuration of the frame, electrical components and the wiring. Therefore, the locations and the numbers of connectors in the frame assembly may vary. However, with the inventions set forth herein, the wiring and connection configurations lead to fewer couplings, simpler wiring layouts, easier assembly and easier maintenance than are available in conventional frame assemblies. They also contribute to creation of modular assemblies and modular production, as well as more uniformity in design and manufacture than was previously available.

Such an arrangement eliminates the use of many crimp-on connectors. With respect to the "hot" power transmission wire, for example, conventional connection methods used three connectors to be crimped along the length of the power transmission wire and used one connector to be crimped onto the end. The present method of connecting the wires also results in an overall wiring scheme which is much easier to service, especially when used in combination with the present forward facing raceway.

The other power transmission wires may be connected in the same way. For example, "hot," "neutral" and "ground" power transmission wires 152, 154 and 156 may be brought into the frame to supply power to a pair of ballasts, such as those illustrated in FIG. 4, and connected to one wire in/many wire out connectors 158, 160 and 162. Power transmission wires 164*a*, 166*a* and 168*a* may then be connected to the input side of one of the ballasts, while power transmission wires 164*b*, 166*b* and 168*b* may be connected to the input side of other. Turning to the heating elements, "hot" and "neutral" power transmission wires 170 and 172 may be brought into the frame and connected to one wire in/many wire out connectors 174 and 176. Lead wires 178*a* and 180*a* from one heating element, and 178*b* and

180*b* from the other, may then be connected to the connectors 174 and 176 in the manner illustrated in FIG. 11.

Figure 12:
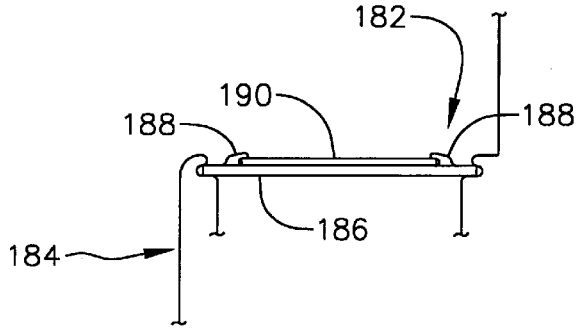
FIG. 12 is a cross section of part of a frame element with an alternative contact plate in accordance with another aspect of the present inventions.

In FIG. 12, an alternative contact plate 182 is shown mounted in a frame element 184, which may be any configuration of frame element either conventional or as described herein. The contact plate 182 includes a plastic or other relatively non-thermally conductive base 186 retained in the frame in a conventional manner, such as by a zipper strip (not shown). The base 186 may be a plastic tape, strip or other support having sufficient strength and resiliency to withstand the flexing and impact encountered in a door and frame assembly for a refrigerated display case. The base 186 includes one or more retaining ridges or grooves 188 for accepting and retaining a metallic, preferably non-ferrous strip 190 for interacting with the magnetic element on the door gasket. The width of the strip 190 relative to the overall width of the base 186 is preferably maximized so that the contact plate can still interact with the door gasket even when the door gasket is not perfectly aligned with the contact plate, such as when the door has been adjusted for sag. The base 186 is preferably plastic or another suitable material to minimize any thermal conduction between the cold part of the case and the outside of the case. A material for the contact plate that has a low thermal conductivity may also eliminate the need for any heater wire in the area of the contact plate. A suitable material for the base 186 may be a high impact PVC.

Although the present inventions have been described in terms of the preferred embodiments above, numerous modifications and/or additions to the above-described preferred embodiments would be readily apparent to one skilled in the art. By way of example, but not limitation, displacement couplings such as those manufactured by Minnesota Mining & Manufacturing may be used in place of the aforementioned one wire in/many wire out connectors. It is intended that the scope of the present inventions extend to all such modifications and/or additions.

What is claimed is:

1. A frame for use in a refrigerated enclosure, comprising:

an upper frame member defining first and second end regions;

a lower frame member defining first and second end regions;

first and second side frame members, the first side frame member extending from the first end region of the lower frame to the first end region of the upper frame and the second side frame member extending from the second end region of the lower frame to the second end region of the upper frame;

wherein each of the upper, lower and side frame members includes a forward facing channel; and at least one power transmission wire located within at least one of the forward facing channels.

2. A frame as claimed in claim 1, wherein the forward facing channel in the upper and lower frame members are connected to the forward facing channels in the side frame members.

3. A frame as claimed in claim 1, wherein the forward facing channels in each of the frame members includes at least one power transmission wire.

* * * * *